United States Patent [19]

Johnson et al.

[11] 4,210,978

[45] Jul. 8, 1980

[54] AUTOMATIC CARPET CLEANING MACHINE

[75] Inventors: Richard C. Johnson; Otto R. Kafer, both of Saint Paul; Mike J. Todd, Rosemount, all of Minn.

[73] Assignee: H. B. Fuller Company, Saint Paul, Minn.

[21] Appl. No.: 862,377

[22] Filed: Dec. 20, 1977

[51] Int. Cl.[2] ..... A47L 11/292; A47L 11/30

[52] U.S. Cl. ..... 15/320; 15/340; 180/2 R; 180/65 B; 191/4

[58] Field of Search ..... 15/320, 340; 180/2, 180/65 R, 65 B; 191/4

[56] References Cited

U.S. PATENT DOCUMENTS

| | | | |
|---|---|---|---|
| 1,975,380 | 10/1934 | Streich et al. | 15/320 |
| 3,010,129 | 11/1961 | Moore | 15/340 X |
| 3,060,484 | 10/1962 | Krammes | 15/320 |
| 3,117,337 | 1/1964 | Krammes | 15/320 |
| 3,277,511 | 10/1966 | Little et al. | 15/340 X |
| 3,402,420 | 9/1968 | Schaeffer | 15/320 |
| 3,584,330 | 6/1969 | Wallin et al. | 15/353 X |
| 3,699,607 | 10/1972 | Putt | 15/320 |
| 4,114,229 | 9/1978 | Jones et al. | 15/320 |

*Primary Examiner*—Christopher K. Moore
*Attorney, Agent, or Firm*—Merchant, Gould, Smith, Edell, Welter & Schmidt

[57] ABSTRACT

An improved self-propelled carpet cleaning machine comprises a body movably mounted by a drive wheel. The body is powered by a drive motor which may be selectively connectable either to an AC power source located separately from the body or to a DC power source contained in the body. In addition, the body includes a first storage chamber for receiving fresh cleaning solution therein and a second storage chamber for receiving spent cleaning solution therein. The first and second storage chambers are provided by a flexible membrane which divides an enclosed cavity into two parts. A scrubbing means is also carried by the body in back of the drive wheel on the body. The scrubbing means includes means for applying the fresh cleaning solution to the carpet, a brush roller for agitating the carpet fibers contacted by the cleaning solution to remove foreign material therefrom, and a vacuum shoe for removing the spent cleaning solution from the carpet and placing that solution in the second storage chamber.

11 Claims, 7 Drawing Figures

FIG. 1
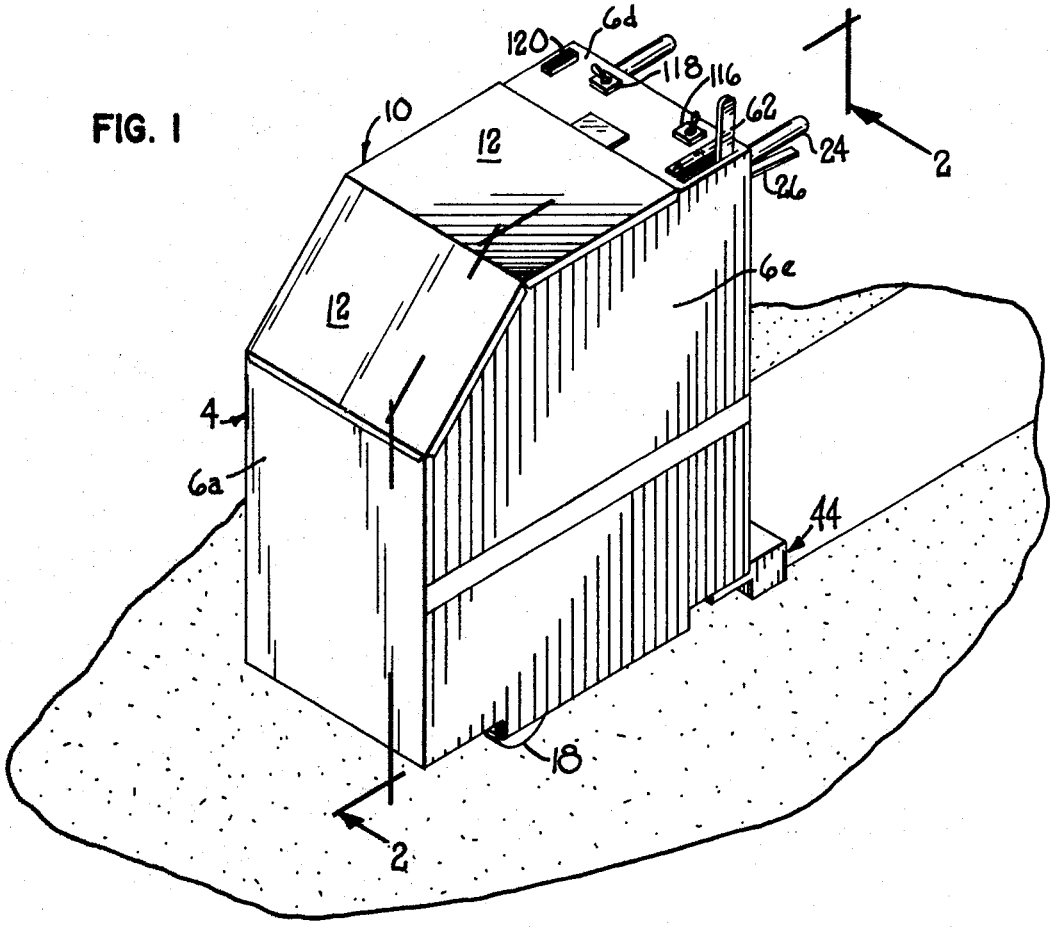
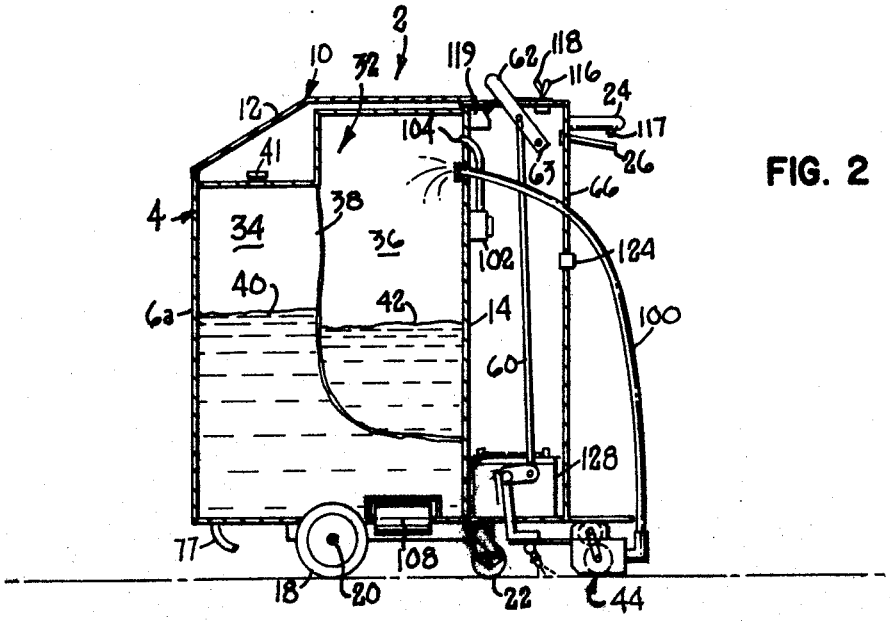
FIG. 2

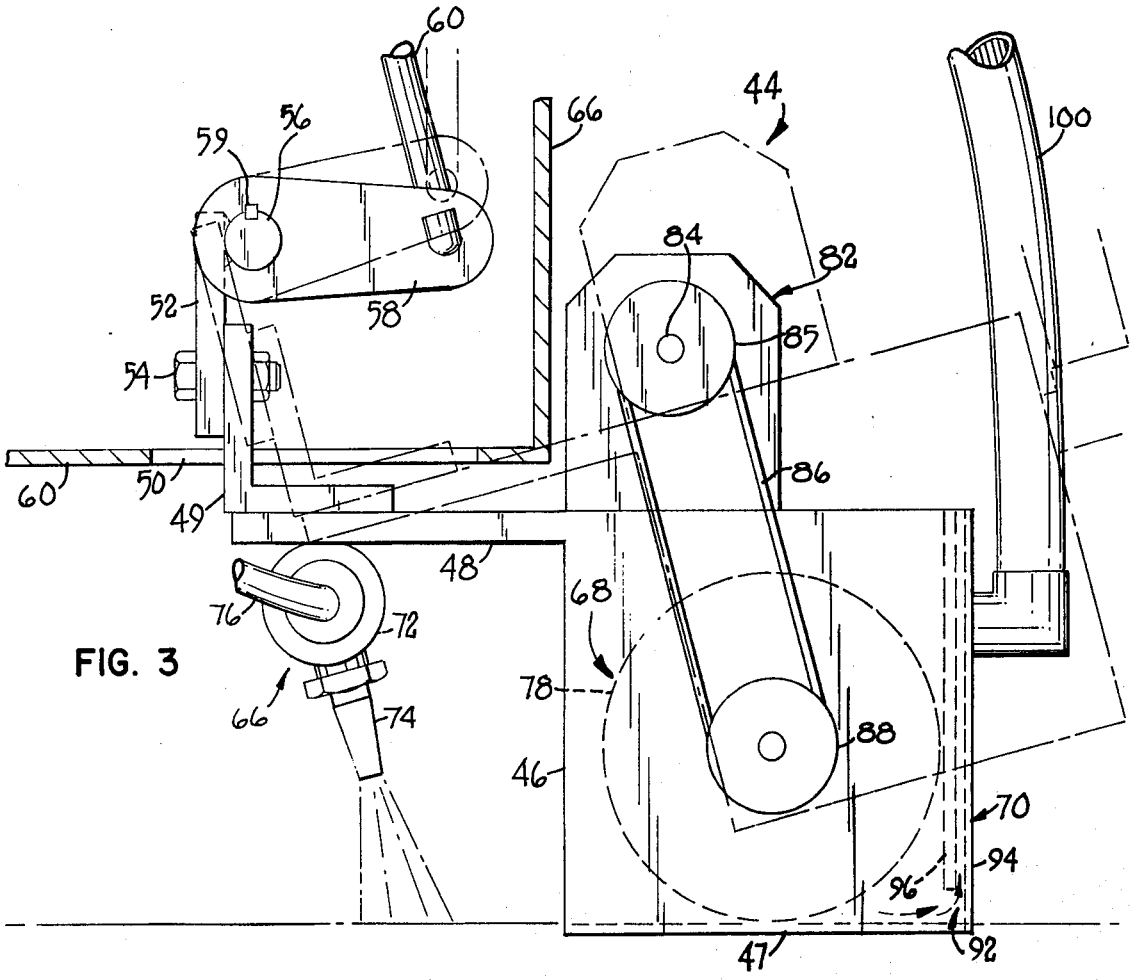
FIG. 3
FIG. 4
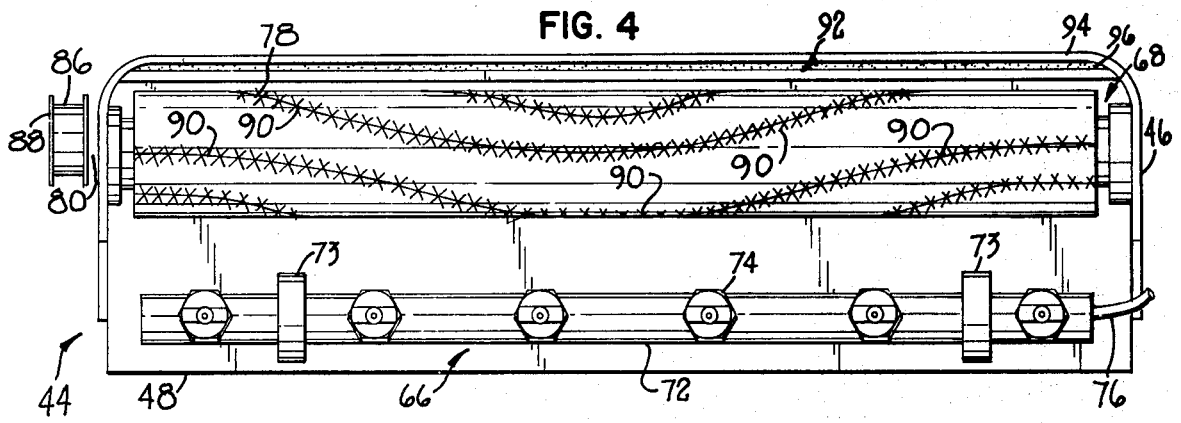
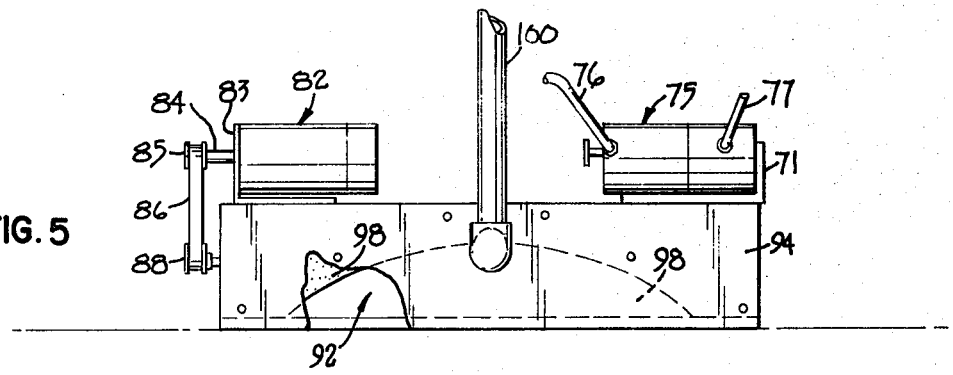
FIG. 5

FIG. 7
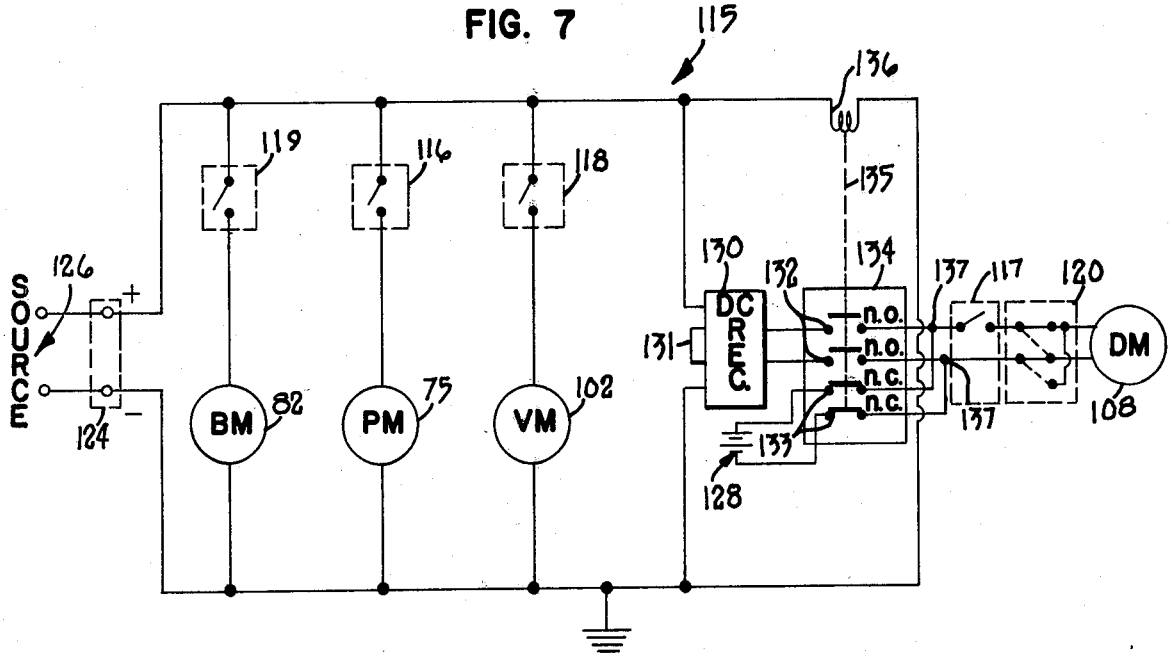
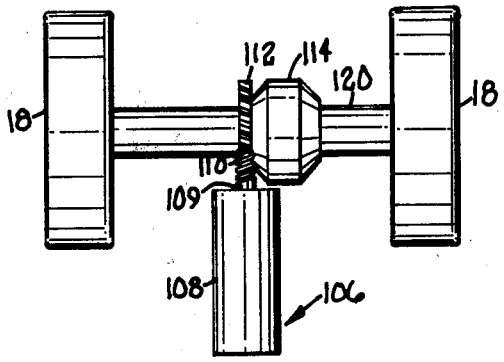
FIG. 6

AUTOMATIC CARPET CLEANING MACHINE

BACKGROUND OF THE INVENTION

1. Field of the Invention

The present invention relates to machines for cleaning fibrous floor coverings, such as carpets and the like. More particularly, the present invention relates to a carpet cleaning machine for use in cleaning relatively large carpeted areas (e.g. carpeted hotel lobbies and hallways, theatre lobbies, convention rooms, etc.).

2. Description of the Prior Art

Recent years have seen a tremendous growth in the use of carpets as floor coverings. The use of carpets as a general purpose floor covering has been widespread in both commercial and residential building units. For example, most hotels, convention centers, shopping centers, theatres, and the like have relatively large carpeted areas. Such large carpeted areas present certain unique problems in terms of cleaning and maintaining the carpeting.

Many devices have previously been used for cleaning carpeting. One type of prior art carpet cleaning machine is generally known as a Shampoo-N-Vac unit and is manufactured by the Multi-Clean® Products Division of H. B. Fuller Company. This unit comprises a hand held wand which is placed in contact with the carpet to be cleaned. The wand has a fan jet nozzle for spraying a cleaning solution under pressure into contact with the carpet. The wand also contains a vacuum head for picking up the cleaning solution and the dislodged dirt from the carpet. The Shampoo-N-Vac unit does not utilize any positive agitation of the carpet fibers other than that provided by the cleaning solution spray. Two additional hand held units for cleaning carpeting are known generally by the trade names of Karpet Champ® and Carpet Pro. These units are also manufactured by the Multi-Clean® Products Division of H. B. Fuller Company and operate on generally similar principles. Both the Karpet Champ® and the Carpet Pro units have a rotatable brush for agitating the carpet fibers as a foamed cleaning medium is applied thereto. A liquid cleaning solution is held in a container on the handle of the cleaning unit and is foamed as it is being dispensed towards the carpeting. However, after the foamed cleaning medium has been applied to the carpet and agitated by the brush, it is left to dry on the carpet. This requires that the cleaning medium be vacuumed up thereafter.

Although the above-noted carpet cleaning units are quite effective in cleaning carpeting and other fibrous floor coverings, they are not designed for efficiently cleaning large carpeted areas. For one thing, because these units are hand held, the rate of cleaning depends partially on the rate at which an operator can manually move the units in contact with the carpet. In addition, with regard to the cleaning units known as the Karpet Champ® and the Carpet Pro, the need to go back and vacuum off the dried cleaning medium increases the time necessary for cleaning the carpet. Although such a time increase is not significant when cleaning relatively small areas of carpeting, the same increase is quite significant when cleaning large expanses of carpeting.

Other devices have also been previously used for cleaning capeting. Some of these devices generally comprise a hand operated cleaning unit having an undriven roller or support wheel, a series of spray nozzles for spraying a liquid cleaning solution into contact with the carpet, a brush means for agitating the carpet, and a vacuum shoe for picking up the cleaning solution from the carpet. This type of device is operated by dragging the cleaning unit across the carpeting in a rearward direction rather than by pushing the unit in a forward direction. This is to ensure that the cleaning unit does not roll over the area of carpeting which has just been cleaned. In addition, a second auxilary unit is provided for storing a supply of the cleaning fluid therein. The auxilary unit also provides a vacuum source which may be connected to the vacuum shoe for drawing up the spent cleaning solution from the carpeting.

Although this latter type of unit is somewhat more effective in cleaning large carpeted areas than the units first described above, this unit still has various disadvantages in performing such a task. These disadvantages result partially from the fact that two separate units are needed (i.e. both a hand operated cleaning unit and a separate auxilary storage unit). Both of these units must be separately moved and set up in a cleaning position. In addition, various elongated flexible hoses must be provided for connecting the two units together. Moreover, an operator can only clean the area immediately adjacent to the storage tank over the area of reach of the connecting hoses. When the operator desires to clean an area outside this reach, the storage unit must first be repositioned. The operator must also manually push or move the cleaning unit to clean the carpeting. All of the above factors increase both the amount of time needed to clean the carpeting and the difficulty which the operator encounters in using the machine.

Another prior art cleaning device is generally similar to the machines just described in that a separate storage unit and a separate cleaning unit are provided. In addition, the cleaning unit of this device utilizes a plurality of rotating jets for spraying the cleaning solution into contact with the carpeting. These jets are motor driven so that the solution also agitates the carpet fibers. However, the necessary drive mechanism for these jets increases the purchase cost and complexity of this machine. In addition, this machine has the various disadvantages of the dual unit cleaning machines noted above.

Other cleaning machines are known which utilize a cleaning solution storage tank that is incorporated with a plurality of cleaning brushes on a power driven movable body. Examples of such a machine are the 21B and 21E Automatic Scrubbers, manufactured by the Multi-Clean® Products Division of H. B. Fuller Company. In this machine, a cleaning solution is first applied to a floor surface. A plurality of brushes which rotate about a vertical axis are arranged at the front of the machine to scrub the floor surface after application of the cleaning solution. A vacuum squeegee is mounted at the rear of the machine to pick up the cleaning solution from the floor surface. However, the 21B and 21E Automatic Scrubbers are not suitable for cleaning fibrous floor coverings such as carpeting. These machines have been designed for cleaning only relatively hard floor surfaces, such as stone or brick floors and the like.

SUMMARY OF THE INVENTION

One aspect of the present invention is to provide an automatic carpet cleaning machine which is suitable for cleaning relatively large areas of a fibrous floor covering. Another aspect of the present invention is to provide such a carpet cleaning machine which is both inexpensive to manufacture and purchase and which is easy for an operator to use.

The carpet cleaning machine of the present invention comprises a body. The body is movably supported by at least one drive wheel for movement over the carpet. The body carries a storage means comprising a first storage chamber for receiving fresh cleaning solution therein and a second storage chamber for receiving spent cleaning solution therein. A flexible membrane divides an enclosed cavity in the body into the first and second storage chambers. The body also carries a scrubbing unit or means for cleaning the carpet. The scrubbing means includes a nozzle means for applying fresh cleaning solution to the carpet, a rotatable brush means for agitating the fresh cleaning solution in contact with the carpet to remove foreign material therefrom, and a vacuum means for removing the spent cleaning solution from the carpet. This scrubbing unit is arranged in back of the drive wheel of the body such that the drive wheel does not leave any tracks on the carpet which has been cleaned by the scrubbing means. In addition, the body is powered by a drive means which may be selectively connected either to a first power source located separately from the body or to a second power source self contained in the body. This drive means preferably comprises an electrical direct current drive motor operatively connected to the drive wheel.

BRIEF DESCRIPTION OF THE DRAWINGS

The present invention will be described hereafter in the Detailed Description, when taken in conjunction with the following drawings, in which like numerals refer to like elements throughout.

FIG. 1 is a perspective view of an automatic carpet cleaning machine according to the present invention;

FIG. 2 is a cross-sectional view of the automatic carpet cleaning machine shown in FIG. 1, taken along the lines 2—2 in FIG. 1;

FIG. 3 is a side elevational view of a scrubbing unit which comprises a portion of the automatic carpet cleaning machine shown in FIG. 1;

FIG. 4 is a bottom view of the scrubbing unit shown in FIG. 3;

FIG. 5 is a rear elevational view of the scrubbing unit shown in FIG. 3;

FIG. 6 is a bottom plan view showing the drive means for the drive wheels of the automatic carpet cleaning machine shown in FIG. 1; and FIG. 7 is a schematic view illustrating the control circuit for the automatic carpet cleaning machine shown in FIG. 1.

DETAILED DESCRIPTION

Referring first to FIG. 1, an automatic carpet cleaning machine according to the present invention is generally indicated as 2. Cleaning machine 2 is particularly suited for cleaning carpeting and rugs made from various fibrous materials (e.g. nylon, wool, etc.). More particularly, cleaning machine 2 is designed and suited for cleaning carpeting on a large commercial scale, i.e. for cleaning large carpeted areas such as those customarily found in convention centers, hotel hallways and lobbies, theatre lobbies, and the like. In addition, the carpet cleaning machine 2 according to the present invention is designed for cleaning carpeting in a single pass. It is, therefore, efficient in terms of the amount of labor needed to run the machine and the amount of time necessary to clean a particular carpeted area.

The Body

Referring now to FIGS. 1 and 2, automatic carpet cleaning machine 2 comprises a substantially hollow housing or body 4. Body 4 has a front wall *6a*, a rear wall *6b*, a bottom wall *6c*, a top wall *6d*, and two transversely spaced side walls *6e*. All of the walls *6a–e* may be made of steel or the like and are integrally connected together to form hollow body 4. The front edge of top wall *6d* is spaced from the upper edge of front wall *6a* to form an inlet opening which gives access to the interior of body 4. This inlet opening is closed by an openable closure door 10. Closure door 10 has two independently pivotable door segments 12 which may be opened to uncover the inlet opening into body 4. The door segments 12 may be pivotably attached to the side walls *6e* of body 4 by means of a transversely extending pivot rod (not shown) positioned at the juncture between the segments 12. Various other means for pivotably mounting door segments 12 could also be used (e.g. a separate pivot rod for each segment). In addition, body 4 has a vertically extending bulkhead 14 which extends through the body between the top and bottom walls *6c* and *6d* thereof. Bulkhead 14 divides the body 4 into a forward and rearward portion.

Two transversely spaced drive wheels 18 are rotatably carried by a transversely extending axle 20 mounted to the bottom wall *6c* of body 4. In addition, two transversely spaced caster wheels 22 are positioned in line with and to the rear of drive wheels 18. Body 4 is longitudinally movable over the carpeting by virtue of the drive wheels 18 and the caster wheels 22. An operator may guide body 4 during this movement by means of two outwardly extending handles 24 which project rearwardly from the rear wall *6b* of body 4. As shown in FIG. 2, one of the handles 24 has a switch 117 associated therewith. Switch 117 is actuated by a pivotally mounted deadman control lever 26 whenever an operator grasps the handles 24. Actuation of switch 117 will operate a drive means for propelling body 4 in forward or reverse directions as will be discussed hereafter.

Cleaning Solution Storage Means

Body 4 comprises a storage means for storing both a supply of fresh cleaning solution (i.e. unused cleaning solution before application to the carpet) as well as a supply of spent cleaning solution (i.e. used cleaning solution previously applied to a carpet to remove foreign material, such as dirt). As shown in FIG. 2, the solution storage means generally comprises the entire forward portion of body 4 located in front of bulkhead 14. This forward portion has a top wall 30 which defines an enclosed cavity 32 received inside body 4. Cavity 32 is defined by the volume between the front wall *6a*, the side walls *6e*, the bottom wall *6c*, the top wall 30, and bulkhead 14. Cavity 32 is maintained in a fluid-tight relationship (e.g. by sealing the junctions between the above-noted walls which define the cavity).

Cavity 32 is divided into a first storage chamber 34 and second storage chamber 36 by a flexible membrane or partition member 38. Membrane 38 is made from any suitably resilient and fluid-tight material, such as a sheet of polyethylene plastic. First storage chamber 34 receives therein a supply of fresh cleaning solution 40. In this regard, first storage chamber has a closable cap 41 provided in top wall 30 for the purpose of filling storage chamber 34 with the fresh cleaning solution 40. Access may be had to cap 41 by raising the front door segment 12 of the closure door 10 upwardly. Second storage chamber 36 receives therein a supply of spent cleaning solution 42. Spent cleaning solution 42 will carry foreign material, such as dirt, entrained therein. The cleaning solution which is utilized to clean the carpet may be any conventional liquid or semi-liquid solution that is customarily used for this purpose.

The volumes of the first and second storage chambers 34 and 36 are inversely proportional relative to one another. For example, the first storage chamber 34 is initially filled with a large supply of fresh cleaning solution 30. In this initial orientation, the fresh cleaning solution 40 will occupy a majority of the cavity 32 distorting the membrane as necessary to substantially, but not completely, fill cavity 32. In other words, the volume of the first storage chamber 34 will initially be at a maximum when the volume of the second storage chamber 36 is at a minimum. However, as the cleaning machine 2 is used in cleaning the carpet, the fresh cleaning solution 40 will be applied to the carpet in a manner to be described hereafter. After cleaning the carpet, the spent cleaning solution 42 will be recovered and placed back into the second storage chamber 36. As the cleaning progresses, the volume of the first storage chamber 34 will gradually decrease as the volume of the second storage chamber 36 simultaneously gradually increases. When the cleaning has been substantially completed and all the fresh cleaning solution 40 has been substantially recovered as spent cleaning solution 42, the volume of storage chamber 36 will then be at a maximum and the volume of storage chamber 34 at a minimum.

The provision of first and second storage chambers 34 and 36 in a single storage cavity 32 by means of a flexible membrane 38 is an important feature of the present invention. This arrangement obviates the need for two totally separate storage chambers or tanks for holding the fresh and spent cleaning solutions. Thus, the size and weight of the carpet cleaning machine 2 is reduced rendering the machine cheaper to manufacture and easier to handle and operate.

The Carpet Scrubbing Means

A carpet scrubbing means or unit is generally indicated in the drawings as 44. Scrubbing means 44 is adjustably mounted on the rear of body 4 behind the drive wheels 18 and caster wheels 22. Scrubbing unit 44 comprises a generally enclosed rectangular brush housing 46 having an open bottom end 47. The top wall of housing 46 extends outwardly from the rest of housing 46 to define a forwardly projecting horizontal flange 48. An L-shaped mounting bracket 49 is welded to the upper surface of flange 48. In turn, a vertical leg of the mounting bracket 49 extends upwardly through a slot 50 in the bottom wall **6*c* of body 4. L-shaped mounting bracket 49 is attached to a vertical mounting flange 52 by means of a single mounting bolt 54. Mounting bolt 54 is attached to the center of bracket 49 and allows the orientation of brush housing 46 to be adjusted about a forwardly extending axis passing through bolt 54. In other words, mounting bolt 54 allows the brush housing 46 to be tilted. In addition, mounting flange 52 is welded to a stub shaft 56. Stub shaft 56 is rotatably mounted on one of the side walls 6*e* of body 4**.

Stub shaft 56 has a rearwardly projecting ear 58 fixed thereto by a key 59. The free end of ear 58 is connected to an upwardly extending latch rod 60. Referring to FIG. 2, latch rod 60 extends upwardly through the rear portion of body 4 in back of bulkhead 14. The upper end of latch rod 60 is pivotably connected to the mid-point of a latch lever 62. Latch lever 62 itself is pivoted at one end to body 4 by a pivot pin 63. In addition, the upper end of latch lever 62 extends through the top wall **6*d* of body 4 to define a handle member which an operator can pivot to adjust brush housing 46** as described hereafter.

As shown in FIGS. 2 and 3, when latch lever 62 is pivoted forwardly by the operator, latch rod 60 is moved downwardly thereby rotating ear 58 and stub shaft 56 in a clockwise direction as viewed in FIG. 3. This movement causes brush housing 46 to assume a lower or operative position (shown in solid lines) where the housing engages the carpeting to clean the same. However, when latch lever 62 is moved rearwardly by the operator to the vertical orientation shown in FIG. 1, latch rod 60 is moved upwardly. This rotates ear 58 and stub shaft 56 in a counter-clockwise direction. Such movement of stub shaft 56 rotates the attached brush housing 46 upwardly about the pivot axis defined by shaft 56 until the brush housing 46 reaches an upper or inoperative position (shown in phantom lines) where it no longer engages the carpet. In this inoperative orientation of brush housing 46, cleaning machine 2 may be quickly moved or transported from one location to another. However, whenever a cleaning operation is taking place, brush housing 46 must be maintained in its operative position in engagement with the carpet.

Referring now to FIGS. 3–5, scrubbing means 44 has three separate components for scrubbing and cleaning the carpet. These components include a first means generally indicated as 66 for applying the fresh cleaning solution 40 held in storage chamber 34 to the carpet. In addition, scrubbing means 44 has a second means generally indicated as 68 for agitating the carpet fibers as they are contacted by the cleaning solution. This enables the cleaning solution to more easily pick up or entrain foreign material in the carpeting. This foreign material will include dirt, sand, and other types of particulate material which must be removed from the carpeting. In addition, scrubbing means 44 includes a means 70 for removing the spent cleaning solution 42, which now carries the foreign material, from the carpeting and placing the spent solution 42 in storage chamber 36.

As shown in FIGS. 3 and 4, the fresh cleaning solution applying means 66 comprises a transversely extending manifold 72. Manifold 72 is fixedly attached to the underside of flange 48 by two U-shaped brackets 73. In addition, manifold 72 has a plurality (i.e., six) downwardly projecting spray nozzles 74 extending therefrom. Nozzles 74 are oriented towards brush housing 46 and spray an overlapping pattern of fresh cleaning solution 40 on the carpet to be cleaned. A hydraulic pump 75 is fixedly carried by an L-shaped bracket 71 on the top of brush housing 46. The inlet of pump 75 is connected to the bottom of first storage chamber 34 by a supply line or conduit 77. The outlet of pump 75 is connected by means of a supply line or conduit 76 to one end of manifold 72. When the pump motor 75 is energized in a manner to be described hereafter, fresh cleaning solution 40 will be pumped from the first storage chamber 34 and supplied to manifold 72. This ensures that the spray nozzles 74 will spray the preferred overlapping pattern of cleaning solution onto the carpeting. Preferably, pump 75 operates at a relatively low pressure in spraying the cleaning solution (e.g. 15 to 30 p.s.i.). However, other pressures can be utilized in pump 75 if so desired.

The carpet agitating means 68 is mounted inside brush housing 46 to the rear of the solution applying means 66. Agitating means 68 comprises a rotatable brush roller 78. Brush roller 78 is rotatable on a substantially horizontal axle 80 which is pivotably carried between the side plates of brush housing 46. An electric brush motor 82 is fixedly positioned on top of brush housing 46 by an L-shaped mounting bracket 83. The output shaft 84 of brush motor 82 extends outwardly past the side of brush housing 46 and mounts a drive sprocket 85 on its outer end. Drive sprocket 85 is coupled by means of a drive belt 86 or similar flexible transmission member to a drive sprocket 88 mounted on the outer end of axle 80. Rotation of drive sprocket 88 by brush motor 82 will rotate the brush roller 78 mounted on axle 80.

As shown in FIG. 4, brush roller 78 extends across the entire width of brush housing 46. In addition, brush roller 78 has a plurality of rows (i.e. five) of outwardly projecting and helically arranged brushes 90 thereon. Brushes 90 are any conventional brushes (e.g. bristle brushes) which will thoroughly agitate the carpet fibers and the cleaning solution which was previously applied to the carpet fibers by spray nozzles 74. In addition, as brush roller 78 is rotated, the helical orientation of each row of brushes 90 will move the cleaning solution on the carpet in toward the center of brush housing 46. This preferably facilitates subsequent pick up of the cleaning solution by the solution removing means 80. Brush motor 82 preferably rotates brush roller 78 at a relatively high speed (e.g. approximately 1600 rpm). However, other speeds of rotation may be used for brush roller 78 (e.g. 1000–1800 rpm).

Referring to FIGS. 4 and 5, the spent cleaning solution removing means 70 comprises a vacuum head or shoe 92. Vacuum shoe 92 is formed between the rear wall 94 of brush housing 46 and a vertical wall 96 spaced longitudinally inwardly from rear wall 94. Rear wall 94 is longer than wall 96 and contacts the carpet to act as a squeegee means. A sealing gasket 98 is placed between the spaced walls 94 and 96 and is shaped to give vacuum shoe 92 a semi-circular shape. Vacuum shoe 92 is centered about the mid-point of brush housing 46. In addition, a conduit or vacuum supply line 100 connects vacuum shoe 92 to the second storage chamberf 36 which receives spent cleaning solution 42.

A fan motor 102 (FIG. 2) is located on the rear of bulkhead 14. Fan motorf 102 has an inlet connection 104 in storage chamber 36 which is located above the vacuum supply line 100. When the fan motor 102 is energized, a vacuum or sub-atmospheric pressure is created in the storage chamber 36. This vacuum will be transmitted through supply line 100 to vacuum shoe 92. Vacuum shoe 92 is then operative to pick up spent cleaning solution 42 from the carpet and transmit that solution into storage chamber 36.

The Drive Means

Referring now to FIGS. 2 and 6, a powered drive means is provided for driving body 4 over the carpeting in both forward and reverse directions. Drive means 106 preferably comprises a 24-volt DC electric motor 108. Motor 108 is fixedly carried on body 4 beneath the bottom wall 6c and is positioned to the rear of drive wheels 18. A forwardly extending output shaft 109 of drive motor 108 is provided with a worm gear 110. Worm gear 110 engages a worm gear 112 provided on a conventional differential transmission 114. Differential 114 is operatively mounted to axle 20 of the drive wheels 18. As worm gear 110 is rotated by drive motor 108, the differential 114 supplies a driving power to rotate axle 20 and drive wheels 18.

As shown in FIG. 2, body 4 has an electrical plug connection 124 provided in the rear wall **6*b* thereof. Plug connection 124 is shaped to receive a power supply cord (not shown). This power supply cord couples body 4 to a 110-volt AC power source 126. AC power source 126 is located separately from body 4 (e.g. a wall outlet in the building area whose carpet is being cleaned). As will be described in more detail hereafter, a control circuit 115 enables AC power source 126 to power the drive motor 108 during a carpet cleaning operation. In addition, body 4 has a second self-contained power source comprising a 12-volt DC storage battery 128. Battery 128 is located in back of bulkhead 14 and is also operatively connected by circuit 115 to drive motor 108. Battery 128 is used to power the drive motor 108 whenever the AC power source is not effective to do so. Since battery 128 preferably provides half the rated voltage of drive motor 108, it will power the drive motor at half speed. A battery 128 could be selected to provide the full rated voltage of drive motor 108**. However, a 12-volt battery has been selected since this is a standard battery size.

The Control Circuit

A control circuit 115 is provided in body 4 for controlling the operation of carpet cleaning machine 2. Referring to FIGS. 1, 2, and 7, this circuit includes a plurality of manually actuable switches (e.g. switches 116–120) for use in selectively operating the various components of carpet cleaning machine 2. For example, first and second normally open switches 116 and 118 are mounted in the wall **6*d* of body 4 for manual actuation by the machine operator. When switch 116 is closed, hydraulic pump motor 75 is energized by the AC power source 126. Similarly, when switch 118 is closed, the vacuum motor 102 is energized by AC power source 126. Another normally open switch 119 is positioned on bulkhead 14 beneath top wall 6*d*. Switch 119 is closed whenever latch lever 62 is pivoted to its forward position to cause the brush housing 46 to assume its lower position. When switch 119 is closed in this manner, brush motor 82 is energized by AC power source 126. Thus, pump motor 75, brush motor 82, and vacuum motor 102 are all connected in parallel to the AC power source 126 through the normally open switches 116, 118, and 119. In order for these motors to be driven when these switches are closed, the AC power source 126 must be coupled by the power supply cord to plug connection 124 on the body 4**.

Referring to FIG. 7, control circuit 115 has means for alternatively connecting drive motor 108 to either AC power source 126 or DC storage battery 128. When plug 124 is connected to AC power source 126, the AC power coming from power source 126 is conducted to a DC rectifier 130. Rectifier 130 normally converts the 110-volt AC power to 24-volt DC power. The output terminals of DC rectifier 130 are connected to two normally open contacts 132 in a four-way solenoid operated switch 134. Switch 134 has two sets of normally open contacts 132 and two sets of normally closed contacts 133. All the contacts 132 and 133 are mechanically coupled together by means of a rod 135 for simultaneous or ganged operation when a coil 136 is energized. In the operation of switch 134, when plug 124 is not connected to the AC power source 126, the coil 136 is not energized. In this case, the normally closed contacts 133 are closed. Contacts 133 are connected to storage battery 128 and thus deliver direct current power from the storage battery 128 through the switch 134 for the purposes of powering drive motor 108. However, when the plug 124 is coupled to AC power source 126, coil 136 is energized, thereby opening the normally closed contacts 133 and closing the normally open contacts 132. Thus, the drive motor 108 will now be powered by the AC power source 126 which has passed through DC rectifier 130 to be normally converted to 24-volt DC power. Rectifier 130 also includes a manually adjustable potentiometer 131 (FIG. 7) which may be used to selectively vary the output voltage of rectifier 130 (e.g. between 0 and 24-volts) to control the speed of drive motor 108.

The output terminals 137 of switch 134 are connected in series to the normally open switch 117. Whenever the deadman lever 26 is closed by the machine operator to close switch 117, the power appearing at the terminals 137 (regardless of whether it is coming from AC power source 126 or battery 128) will be fed through switch 117 to a forward and reverse switch 120. Switch 120 is a two-position switch mounted on the top wall **6*d* of body 4 for manual actuation by the machine operator. Switch 120 has a plurality of switchable contacts which change the polarity of the DC voltage coming through switch 117. For example, when the contacts are in the solid line position shown in FIG. 7, the voltage will have one polarity which causes drive motor 108 to operate in a forward direction. This drives or propels body 4 in a forward direction. However, when switch 120 is actuated so that its contacts are switched to the dotted line position, the polarity of the voltage is reversed. Thus, drive motor 120 will be operated in a reverse direction to cause cleaning machine 2 to back up. In any event, drive motor 108 can be operated alternatively either by the AC power source 126 or by battery 128**.

Operation of the Cleaning Machine

In a preferred manner of operating cleaning machine 2, the machine 2 will usually be stored in a storage or utility area that may be some distance from the carpeted area which is to be cleaned. An operator by grabbing the handles 24 will close the switch 117. This energizes the drive motor 108 from the battery 128. The operator is then able to drive the machine 2 in forward or reverse directions depending on the position of the forward and reverse switch 120. The operator will first remove the cleaning machine from the storage area and fill the storage chamber 34 with fresh cleaning solution 40. The machine 2 is then driven by the operator to the working area which is to be cleaned. At this position, cleaning machine 2 is then coupled by the power supply cord and plug connection 124 to the nearest AC power source 126. Thus, cleaning machine 2 will be operated by AC power source 126 during the actual cleaning operation. This conserves the strength of battery 128 for use in transporting machine 2 from one location to another.

During the carpet cleaning operation, switches 116, 118, and 119 are all manually closed by the operator to energize the various components of scrubbing means 44. Pump motor 75 will send a pressurized flow or spray of fresh cleaning solution 40 through spray nozzles 74 to be applied to the carpeting. Since brush motor 82 is also energized, brush roller 78 will be rotated to agitate the carpet fibers in contact with the cleaning solution 40. Cleaning solution 40 picks up or entrains the foreign material in the carpet. In addition, as the brush roller 78 rotates, the helical orientation of brushes 90 cause the cleaning solution on the carpet to be moved inwardly toward the middle of brush housing 46. Vacuum shoe 92 is then operative (by virtue of vacuum motor 102) to suck or pick up the now spent cleaning solution 42 from the carpet and return the cleaning solution to storage chamber 36. Approximately 90% of the fresh cleaning solution 40 applied to the carpet will be recovered as spent cleaning solution 42. The cleaning operation continues in the above-noted manner until all of the fresh cleaning solution 40 has been applied to the carpet. At this point, cleaning machine 2 is disconnected from its AC power source 126 by uncoupling the power supply cord from plug 124. The operator is then able to return machine 2 to its storage position by means of battery 128 which now powers drive motor 108. After the spent cleaning solution 42 is then removed from storage chamber 36 through a drain hole or the like (not shown) in bulkhead 14 and disposed of, the storage chamber 34 may be refilled with fresh cleaning solution 40 and machine 2 returned to the working area to clean another section of carpeting.

An important feature of carpet cleaning machine 2 is that it is always powered by drive motor 108. Such a powered drive means is necessary because cleaning machine 2 is relatively heavy. For example, storage chamber 34 is relatively heavy. For example, storage chamber 34 preferably holds at least 25 gallons of cleaning solution and may hold up to 30–35 gallons. This amount of cleaning solution will weigh up to 200 pounds without even considering the weight of the hardware on cleaning machine 2. Thus, a powered drive means is necessary to prevent operator fatigue and to enable the operator to handle cleaning machine 2. In addition, it is impractical to have a power supply cord that is long enough to couple body 4 to an AC power source 126 even during the time the machine 2 is being transported from a storage position to a working location. The provision of storage battery 128 for powering body 4 during this transport is a unique feature of the present invention. Thus, there is no interval, either during a cleaning operation or when machine 2 is being transported between its storage position and its working location, in which the operator has to manually push cleaning machine 2.

Another important feature of the present invention involves the location of carpet scrubbing means 44. Scrubbing means 44 is attached to body 4 behind the drive and caster wheels 18 and 22. Thus, the actual cleaning of the carpeting will occur behind the drive wheels 18. When the operator is driving the machine in a forward direction, no wheel tracks will be left on the damp carpeting just cleaned by the scrubbing means 44. Since the weight of cleaning machine 2 is quite high, these wheel tracks would otherwise have been quite pronounced. Although the operator's foot prints might appear in the cleaned carpeting, their effect is negligible and they may be eliminated simply by the operator wearing clean shoes or protective covers over his feet.

Scrubbing means 44 of the present invention is particularly advantageous is cleaning carpeting and other fibrous floor coverings. The combination of the pressurized application of cleaning solution, the rotary agitation of the carpet fibers by the brush roller 78, and the subsequent pick up of the spent cleaning solution ensures a thorough and effective cleaning of the carpeting. Generally, a stretch of soiled carpeting can be cleaned by scrubbing means 44 in a single pass of the cleaning machine 2. This further decreases the amount of time needed by the operator to clean a large carpeted area. It is believed that cleaning machine 2 can be operated at a forward speed of approximately 45 feet per minute at which speed the machine will do a thorough cleaning job. It is also believed that cleaning machine 2 will clean 5,000 square feet of carpeting per hour not including the time needed to empty the storage chamber 36 and fill the storage chamber 34. If such times are included in the computation of the cleaning capacity of cleaning machine 2, it is believed that the cleaning capacity will be on the order of 3,500 square feet of carpeting per hour.

Carpet cleaning machine 2 is suited for cleaning various kinds of carpeting having different fiber lengths and density (e.g. shag rugs vs. closely woven rugs). In this regard, the operator can adjust the speed of cleaning machine 2 to suit the fiber characteristics of the particular rug to give adequate cleaning thereof. For example, when cleaning machine 2 must be run slower than full speed in order to clean a particular rug without damaging it, the operator need only adjust the potentiometer 131 to decrease as necessary the output voltage from rectifier 130. This decreased voltage will power drive motor 108, and hence cleaning machine 4, at a slower speed.

Various modifications will be apparent to those skilled in the art regarding the present invention. Although is is preferred that storage battery 128 be recharged by a battery charger which is not contained on body 4, such a charger could be made self contained in body 4 and would be operative to charge battery 128 whenever the body 4 is connected to AC power source 126. Moreover, the powered drive means for body 4 may be totally battery powered, even during a cleaning operation, if so desired. In addition, the term "cleaning solution" which is used herein is meant to apply to every type of liquid or semi-liquid material, and other types of dispensable materials, which may be used as cleaning mediums for cleaning carpeting. Therefore, the scope of the present invention is to be limited only by the appended claims.

What is claimed is:

1. A carpet cleaning machine, which comprises:

(a) a body movably supported by at least one drive wheel for movement over the carpet;

(b) storage means carried by the body for carrying a supply of the cleaning solution therein;

(c) scrubbing means carried by the body for cleaning the carpet, the scrubbing means comprising:

(i) means for applying the cleaning solution to the carpet; and (ii) means for agitating the cleaning solution in contact with the carpet to remove foreign material therefrom;

(d) an internal power source carried by the body for movement therewith;

(e) powered drive means carried by the body and operatively connected to the drive wheel for moving the body at least in a forward direction; and (f) switching means for selectively connecting the drive means either to an external power source which is located separately from the body or to the internal power source carried by the body, whereby the external power source is utilized to drive the body over a working area during a cleaning operation and the internal power source is utilized to drive the body from a storage area to the working area.

2. A carpet cleaning machine as recited in claim 1, in which the drive means comprises an electrical direct current drive motor, and wherein the external power source comprises an alternating current power source located separately from the body, and wherein the body carries means for converting the alternating current power to direct current power to drive the drive motor, and wherein the internal power source comprises a direct current power source carried by the body.

3. A carpet cleaning machine as recited in claim 2, in which the direct current power source comprises an electrical storage battery.

4. A carpet cleaning machine, which comprises:

(a) a body movably supported by at least one drive wheel for movement over the carpet;

(b) a powered drive means carried on the body and operatively connected to the drive wheel for moving the body at least in a forward direction;

(c) storage means carried on the body for storing cleaning solution therein, the storage means comprising an enclosed fluid-tight cavity in the body which is divided into first and second fluid-tight storage chambers by means of a flexible membrane, wherein the storage means is substantially permanently mounted on the body and the membrane is substantially permanently carried inside the cavity during a plurality of successive carpet cleaning operations so that the first and second storage chambers can be filled and emptied without removing the membrane from the cavity or the storage means from the body, and wherein the volumes of the first and second storage chambers are inversely related to one another such that the volume of the first storage chamber is at a maximum when the volume of the second storage chamber is at a minimum, the first storage chamber being suitable for containing fresh cleaning solution therein and the second storage chamber being suitable for containing spent cleaning solution therein;

(d) scrubbing means carried by the body for cleaning the carpet, the scrubbing means comprising:

(i) means for applying the fresh cleaning solution held in the first storage chamber to the carpet, the applying means including pump means for withdrawing the fresh cleaning solution from the first storage chamber;

(ii) means for agitating the fresh cleaning solution in contact with the carpet to remove foreign material therefrom, whereby the fresh cleaning solution is converted into the spent cleaning solution; and (iii) means for removing the spent cleaning solution from the carpet and placing the spent solution in the second storage chamber, wherein the removing means includes means for drawing a vacuum in the second storage chamber for picking up and transporting the spent cleaning solution thereto; and (e) control means for simultaneously activating the pump means and vacuum drawing means, whereby spent cleaning solution is placed into the second storage chamber as fresh cleaning solution is removed from the first storage chamber.

5. A carpet cleaning machine as recited in claim 4, in which the applying means comprises:

(a) a plurality of spray nozzles arranged above the carpet; and (b) wherein the pump means is operatively connected between the spray nozzles and the first storage chamber for pumping the fresh cleaning solution held therein through the spray nozzles for application to the carpet.

6. A carpet cleaning machine as recited in claim 5, wherein the spent cleaning solution removing means comprises:

(a) a fan motor for maintaining sub-atmospheric pressure in the second storage chamber and defining the vacuum drawing means; and (b) a vacuum shoe placed in contact with the carpet and operatively connected by a conduit to the second storage chamber, whereby the sub-atmospheric pressure created in the second storage chamber draws spent cleaning solution from the carpet and through the vacuum shoe and transports it into the second storage chamber.

7. A carpet cleaning machine as recited in claim 6, in which the agitating means comprises a brush roller pivotally carried on the scrubbing means for rotation about a substantially horizontal axis, and wherein the brush roller has a plurality of rows of brushes.

8. A machine for cleaning a fibrous floor covering, which comprises:

(a) a body movably supported by at least one drive wheel for movement over the fibrous floor covering;

(b) storage means carried on the body for storing cleaning solution therein, the storage means comprising an enclosed cavity in the body which is divided into first and second fluid-tight storage chambers by means of a flexible membrane, wherein the storage means is substantially permanently mounted on the body and the membrane is substantially permanently carried inside the cavity during a plurality of successive carpet cleaning operations so that the first and second storage chambers can be filled and emptied without removing the membrane from the cavity or the storage means from the body, wherein the volumes of the first and second storage chambers are inversely related to one another, such that the volume of the first storage chamber is at a maximum when the volume of the second storage chamber is at a minimum, the first storage chamber being suitable for containing fresh cleaning solution therein and the second storage chamber being suitable for containing spent cleaning solution therein;

(c) scrubbing means carried on the body for cleaning the fibrous floor covering, the scrubbing means comprising:

(i) means for applying the fresh cleaning solution held in the first storage chamber to the fibrous floor covering, the applying means including pump means for withdrawing the fresh cleaning solution from the first storage chamber;

(ii) means for agitating the fresh cleaning solution in contact with the fibrous floor covering, whereby the fresh cleaning solution removes foreign material from the fibrous floor covering and is thereby converted into a spent cleaning solution and, (iii) means for removing the spent cleaning solution from the fibrous floor covering and placing the spent cleaning solution in the second storage chamber, wherein the removing means includes means for drawing a vacuum in the second storage chamber for picking up and transporting the spent cleaning solution thereto; and (d) control means for simultaneously activating the pump means and vacuum drawing means, whereby spent cleaning solution is placed into the second storage chamber as fresh cleaning solution is removed from the first storage chamber; and (e) powered drive means carried on the body and operatively connected to the drive wheel for moving the body at least in a forward direction, and wherein the scrubbing means is carried on the body rearwardly of the drive wheel in the forward direction of movement of the body, whereby the drive wheel of the body does not leave any tracks on the fibrous floor covering cleaned by the scrubbing means.

9. A machine for cleaning carpet, which comprises:

(a) a body movably supported by at least one drive wheel for movement over the carpet;

(b) a powered drive means carried by the body and operatively connected to the drive wheel for moving the body at least in a forward direction;

(c) a storage means comprising a first storage chamber suitable for receiving fresh cleaning solution therein and a second storage chamber suitable for receiving spent cleaning solution therein;

(d) scrubbing means for cleaning the carpet, the scrubbing means comprising:

(i) spray nozzle means for applying a fresh cleaning solution held in the first storage chamber to the carpet;

(ii) brush means for agitating the fresh cleaning solution in contact with the carpet to remove foreign material therefrom, the brush means comprising a brush roller mounted in a brush housing, and wherein the brush roller is arranged for rotation relative to the body about a horizontal axis, the brush roller having at least one row of brushes, and wherein the fresh cleaning solution is converted into the spent cleaning solution as it receives foreign material from the carpet;

(iii) vacuum means for removing the spent cleaning solution from the carpet and transporting the spent cleaning solution to the second storage chamber, wherein the vacuum means includes a vacuum source operatively connected to a vacuum shoe for contacting the carpet which shoe is integrally formed as part of the brush housing, and (e) wherein the brush housing includes at least a first vertical wall, and further including a second vertical wall which is spaced from the first wall and is sealed relative thereto by a downwardly opening sealing gasket located between the walls, whereby the vacuum shoe is defined by the space between the walls beneath the gasket.

10. A machine for cleaning a fibrous floor covering, which comprises:

(a) a body movably supported by at least one drive wheel for movement over the fibrous floor covering;

(b) storage means carried on the body for storing cleaning solution therein, the storage means comprising an enclosed cavity in the body which is divided into first and second storage chambers by means of a flexible membrane, wherein the volumes of the first and second storage chambers are inversely related to one another, such that the volume of the first storage chamber is at a maximum when the volume of the second storage chamber is at a minimum, the first storage chamber being suitable for containing fresh cleaning solution therein and the second storage chamber being suitable for containing spent cleaning solution therein;

(c) scrubbing means carried on the body for cleaning the fibrous floor covering, the scrubbing means comprising:

(i) means for applying the fresh cleaning solution held in the first storage chamber to the fibrous floor covering;

(ii) means for agitating the fresh cleaning solution in contact with the fibrous floor covering, whereby the fresh cleaning solution removes foreign material from the fibrous floor covering and is thereby converted into a spent cleaning solution and, (iii) means for removing the spent cleaning solution from the fibrous floor covering and placing the spent cleaning solution in the second storage chamber; and (d) powered drive means carried on the body and operatively connected to the drive wheel for moving the body at least in a forward direction, and wherein the scrubbing means is carried on the body rearwardly of the drive wheel in the forward direction of movement of the body, whereby the drive wheel of the body does not leave any tracks on the fibrous floor covering cleaned by the scrubbing means, and wherein the drive means comprises a drive motor and an internal power source carried by the body and further including switching means for selectively connecting the drive motor either to an external power source which is located separately from the body or to the internal power source carried by the body, whereby the external power source is utilized to drive the body over a working area during a cleaning operation, and the internal power source is utilized to drive the body from a storage area to the working area.

11. A machine for cleaning a fibrous floor covering as recited in claim 10, in which the drive motor comprises an electrical direct current drive motor, and in which the external power source comprises an alternating current power source which is located separately from the body, and wherein the body includes rectifier means for converting the alternating current power to direct current power, and wherein the internal power source comprises a direct current power source carried by the body.

* * * * *

UNITED STATES PATENT AND TRADEMARK OFFICE

CERTIFICATE OF CORRECTION

PATENT NO. : 4,210,978

DATED : July 8, 1980

INVENTOR(S) : Richard C. Johnson et al

It is certified that error appears in the above-identified patent and that said Letters Patent are hereby corrected as shown below:

In column 7, line 50, for "motorf" read --motor--.

In column 10, line 67, for "is" read --in--.

Signed and Sealed this

*Fourteenth* Day of *October 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,210,978

DATED : July 8, 1980

INVENTOR(S) : Richard C. Johnson et al

It is certified that error appears in the above-identified patent and that said Letters Patent are hereby corrected as shown below:

In column 11, line 34, for "Although is" read --Although it--.

Signed and Sealed this

*Ninth* Day of *December 1980*

[SEAL]

*Attest:*

SIDNEY A. DIAMOND

*Attesting Officer*

*Commissioner of Patents and Trademarks*